US011466465B2

(12) United States Patent
Mehlenbacher

(10) Patent No.: US 11,466,465 B2
(45) Date of Patent: Oct. 11, 2022

(54) TEMPLATE ASSEMBLY FOR LOCATING ANCHOR BOLTS IN A CONCRETE POUR OF A FORM

(71) Applicant: LMC Industrial Contractors, Inc., Dansville, NY (US)

(72) Inventor: Lawrence D. Mehlenbacher, Wayland, NY (US)

(73) Assignee: LMC Industrial Contractors, Inc., Dansville, NY (US)

( * ) Notice: Subject to any disclaimer, the term of this patent is extended or adjusted under 35 U.S.C. 154(b) by 59 days.

(21) Appl. No.: 16/217,975

(22) Filed: Dec. 12, 2018

(65) Prior Publication Data

US 2019/0177989 A1 Jun. 13, 2019

Related U.S. Application Data

(60) Provisional application No. 62/597,802, filed on Dec. 12, 2017.

(51) Int. Cl.

| | |
|---|---|
| ***E04G 21/12*** | (2006.01) |
| ***E04G 19/00*** | (2006.01) |
| ***E04G 21/18*** | (2006.01) |
| ***E04G 13/00*** | (2006.01) |
| *E04G 17/00* | (2006.01) |

(52) U.S. Cl.

CPC ..... *E04G 21/12* (2013.01); *E04G 13/00* (2013.01); *E04G 19/00* (2013.01); *E04G 21/185* (2013.01); *E04G 17/002* (2013.01)

(58) Field of Classification Search

CPC ..... E04G 21/185

See application file for complete search history.

(56) References Cited

U.S. PATENT DOCUMENTS

| | | | | |
|---|---|---|---|---|
| 4,261,544 | A | 4/1981 | Addison | |
| 5,174,083 | A | 12/1992 | Mussell | |
| 5,419,055 | A * | 5/1995 | Meadows | E04G 21/1808 249/219.1 |
| 6,550,213 | B1 | 4/2003 | Butler | |

(Continued)

FOREIGN PATENT DOCUMENTS

| | | | |
|---|---|---|---|
| FR | 2292084 A1 * | 6/1976 | E04F 21/20 |
| WO | 2017044541 A1 | 3/2017 | |

OTHER PUBLICATIONS

Translation of FR 2,292,084 (Year: 1976).*

(Continued)

*Primary Examiner* — Niki Bakhtiari
*Assistant Examiner* — John J DeRusso
(74) *Attorney, Agent, or Firm* — Brian B. Shaw, Esq.; Harter Secrest & Emery LLP

(57) ABSTRACT

The present disclosure provides a template assembly for locating and retaining a plurality of anchor bolts within a form during a concrete pour. The template assembly includes a rigid metal frame and plurality of anchor bolt retainers affixed to the frame, wherein each anchor bolt includes an anchor bolt engaging surface for locating an associated anchor bolt within predetermined tolerances. The frame can be further configured to provide access to at least 75% of the surface of the pour thereby allowing for finishing of the concrete at an optimal time. A plurality of legs can be connected to the frame for adjusting an elevation of the frame.

11 Claims, 10 Drawing Sheets

(56) References Cited

U.S. PATENT DOCUMENTS

| | | | | |
|---|---|---|---|---|
| 7,984,541 | B1 | 7/2011 | Davidson | |
| 2014/0183330 | A1* | 7/2014 | Simmons | E04G 17/14<br>249/49 |
| 2014/0197573 | A1* | 7/2014 | Goss | B29C 39/10<br>264/279.1 |

OTHER PUBLICATIONS

ISA/KR, International Search Report and Written Opinion from PCT/US2018/065222 (International Pub. No. WO/2019/118610 A1) completed Apr. 18, 2019/dated Apr. 19, 2019.

* cited by examiner

TEMPLATE ASSEMBLY FOR LOCATING ANCHOR BOLTS IN A CONCRETE POUR OF A FORM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to locating anchor bolts in a concrete pour and particularly to a template assembly for repeatably and accurately locating a plurality of anchor bolts in a specific, including predetermined, pattern to specific, including predetermined, tolerances within a form for a concrete pour.

Description of Related Art

In the use of concrete foundations, such as footings, it is often necessary to locate an anchor bolt in the concrete at precise locations. While the accuracy of the location of the anchor bolts in some applications is not critical, in those applications that mount devices having predetermined (and unchangeable) locations for engaging the anchor bolts, there must be precise positioning of the anchor bolts, both as to their specific location within the foundation, as well as with respect to other anchor bolts. Previously, when locating a plurality of anchor bolts, a wooden template is created, for example of plywood or boards, wherein holes are then drilled or cut in the wooden template to correspond as nearly as possible to the desired location of each anchor bolt.

However, this approach has certain limitations. For example, problems may arise when the concrete is poured. Specifically, the anchor bolts often rotate during the pouring of concrete, as well as rise or sink in the concrete, thus eventually being set at the wrong level. Additionally, the force, pressure, and weight of the concrete pour often tends to skew the anchor bolts out of the vertical and it is usually impossible, once all the concrete has been poured, to straighten the anchor bolts by twisting the protruding portion of the anchor bolt. Additionally, such large wooden templates do not provide support to allow the proper finishing of the top surface of the concrete. Furthermore, such wood frame templates require a great deal of time and material to produce, are large and cumbersome, and are often inaccurate due to the nature of wood and its tendencies. The wooden frames deflect or bend or absorb moisture along the length, which distortions result in mis-location of the anchor bolts.

In addition, in those constructions in which the anchor bolts are used to support and secure devices having a plurality of pre-machined apertures or slots to engage the anchor bolts, any misalignment can have significant impact on the timing, cost and integrity of the installation. It is important that the anchor bolts or other affixing mechanism requiring similar specific alignment characteristics be accurately cast into the concrete to accept, secure, and support these pre-machined apertures and slots. Failure to locate the anchor bolts accurately with respect to one another, or with respect to the entire concrete surface, or with the equipment to which it is being installed requiring such tolerances, makes it difficult or impossible to seat and secure the devices having pre-machined openings.

Therefore, the need exists for a template assembly that can accurately locate the anchor bolts in and relative to each other and the form, as well as provide for the necessary finishing of the concreate pour.

BRIEF SUMMARY OF THE INVENTION

The disclosure provides a method of locating a plurality of anchor bolts within a concrete pour in a form, the method including the steps of locating a metal frame relative to the form to engage each of a plurality anchor bolts with one of a corresponding plurality of anchor bolt retainers, each anchor bolt retainer being fixedly connected to the metal frame at a predetermined position to dispose and engage the anchor bolt at predetermined relative positions; pouring a sufficient amount of concrete into the form to embed at least a portion of each of the plurality of anchor bolts; at least partially curing the concrete in the form; and moving the frame from the form to separate each of the anchor bolt retainers from the corresponding anchor bolt.

The disclosure further provides a template assembly for cooperating with a form to locate a plurality of anchor bolts in a predetermined relationship within a concrete pour in the form, the template assembly includes a metal frame; a plurality of legs projecting from the frame to at least partially locate the frame relative to the form; and a plurality of anchor bolt retainers fixedly connected to the frame, each anchor bolt retainer including an anchor bolt engaging surface, wherein each anchor bolt engaging surface is disposed in a fixed predetermined position relative to a remaining subset of the plurality of anchor bolt engaging surfaces.

BRIEF DESCRIPTION OF THE SEVERAL VIEWS OF THE DRAWING(S)

DETAILED DESCRIPTION OF THE INVENTION

Figure 1:
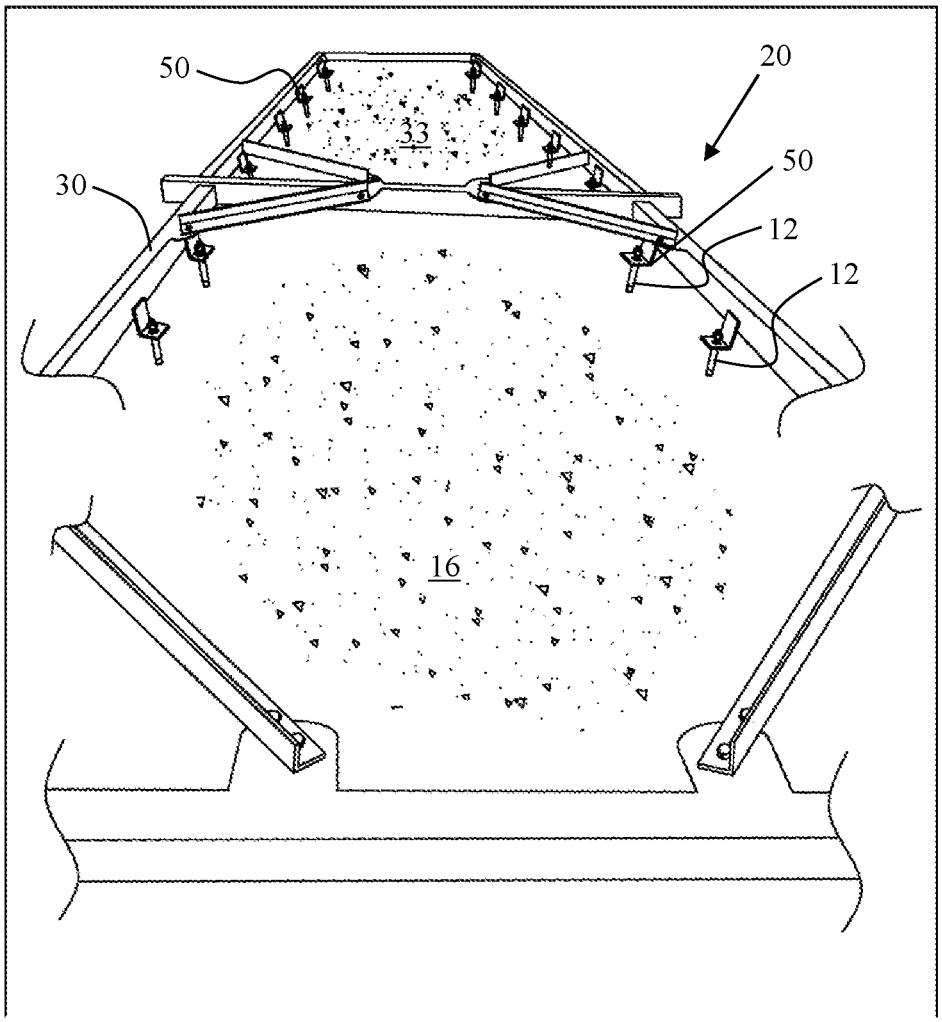
FIG. 1 is an end perspective view of a template assembly engaging a plurality of anchor bolts within a poured form.
Figure 2:
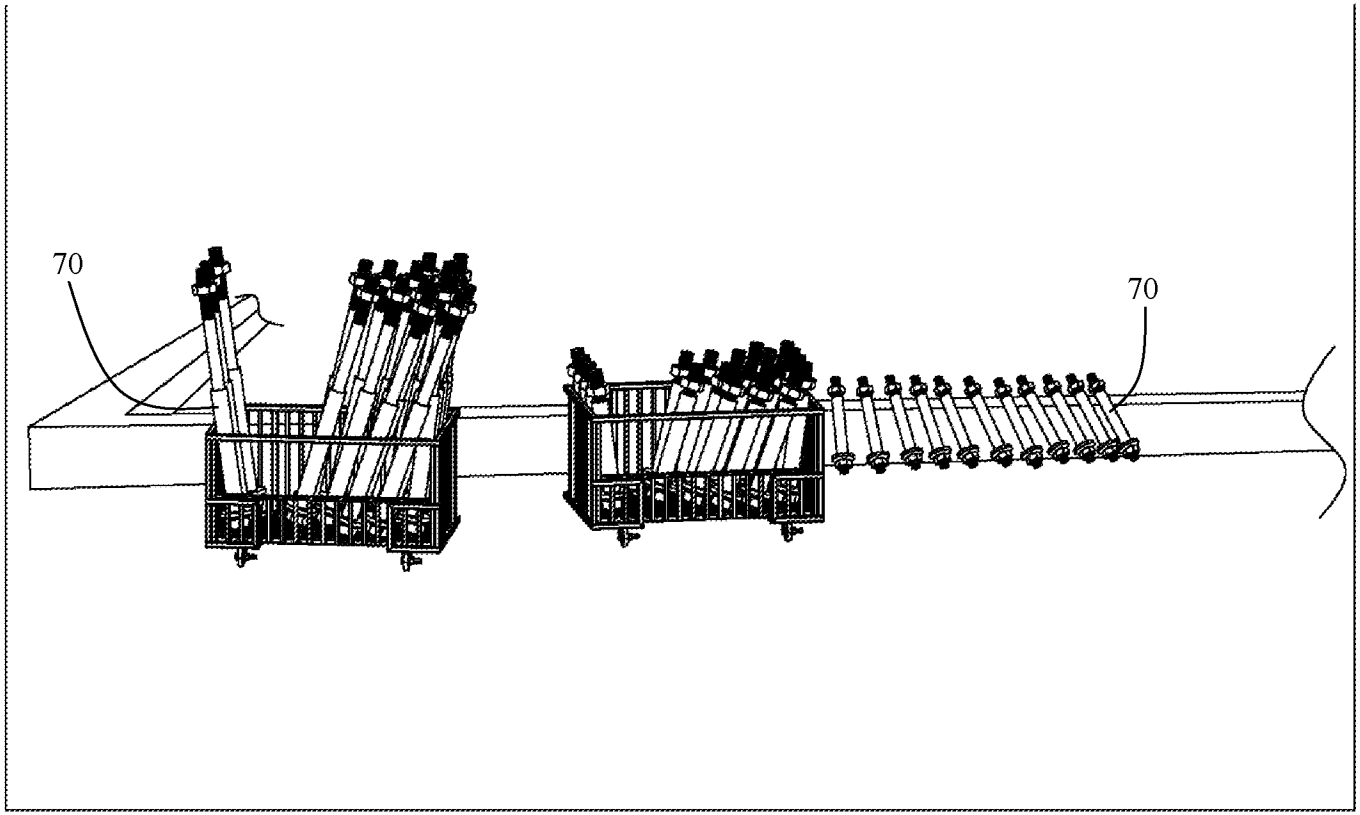
FIG. 2 is a view of a plurality of legs for the template assembly.
Figure 3:
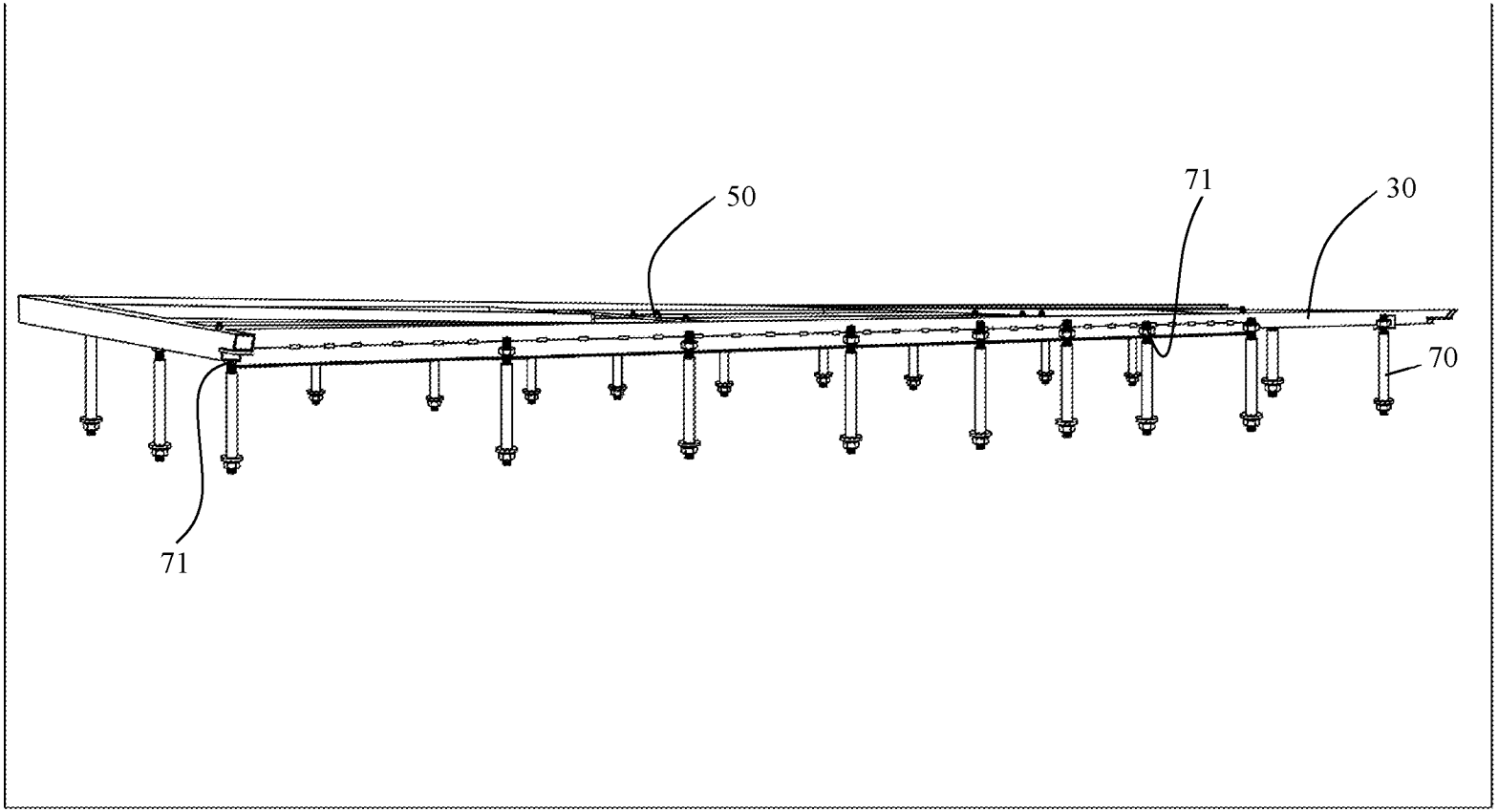
FIG. 3 is a view of a plurality of legs engaged with the template assembly.

Referring to FIG. 1, a template assembly 20 provides a frame 30 having a plurality of anchor bolt retainers 50 for engaging and locating a plurality of anchor bolts 12 in a predetermined bolt pattern within a concrete pour of a form 10, wherein the bolt pattern locates the anchor bolts at predetermined absolute and/or relative positions.

For purposes of the present disclosure, a foundation 16 is a part of the structure which is in contact, typically direct contact, with the ground to which the loads are transmitted. A footing is a type of foundation, typically under the base of a wall or a column, for the purpose of distributing the load over a larger area.

The foundation 16 is configured to support a device (not shown) such as but not limited to structural and non-structural elements, wherein the structural elements can include towers, windmills and non-structural elements include generators or motors. While some devices to be secured to the foundation may have a bolt pattern that accommodates variances in the location of the anchor bolts 12, such as by slots or keyways, many devices to be secured require specific bolt patterns for securing the device to the foundation.

The bolt pattern is the position of the anchor bolts 12 necessary to secure the device to the foundation 16. The bolt pattern can represent absolute positions of the anchor bolts 12, relative positions of the anchor bolts or a combination of relative and actual positions of the anchor bolts. That is, in one configuration, wherein the relative positions of the anchor bolts 12 in the bolt pattern are set, the location of the bolt pattern within the form 10 typically has greater tolerances than the relative location of the anchor bolts 12 within the bolt pattern. Alternatively, the relative position of the anchor bolts is set by the bolt pattern as well as the predetermined location of the bolt pattern relative to the form 10.

The term "anchor bolt" 12 is used to refer to any structural member including without limitation smooth or threaded bolts, rebar, rods, plates and the like for securing the device to the foundation. Typically, the anchor bolts 12 are metal, but can be of any material meeting the particular structural requirements. The use of such anchor bolts 12 ensures that an attached device or structure will not shift with respect to the concrete foundation. Anchor bolts 12 can vary in size, shape and length. Some anchor bolts 12 have an arcuate portion or are generally arcuate, or are hooked to fit around reinforcement metal supports laid within the concrete foundation 16. Most standard anchor bolts 12 are located vertically in the foundation 16, and many are threaded as to allow for the secure attachment to the device. Thus, the term anchor bolt 12 includes any affixing mechanism requiring specific alignment characteristics to be accurately cast into the concrete pour of a foundation 16 to accept, secure, and support pre-machined apertures, slots or fittings of the device to be attached.

The form 10 includes any mold like structure into which concrete is poured to form the foundation upon which the device, such as a piece of equipment or structure rests, and is to be attached.

Figure 4:
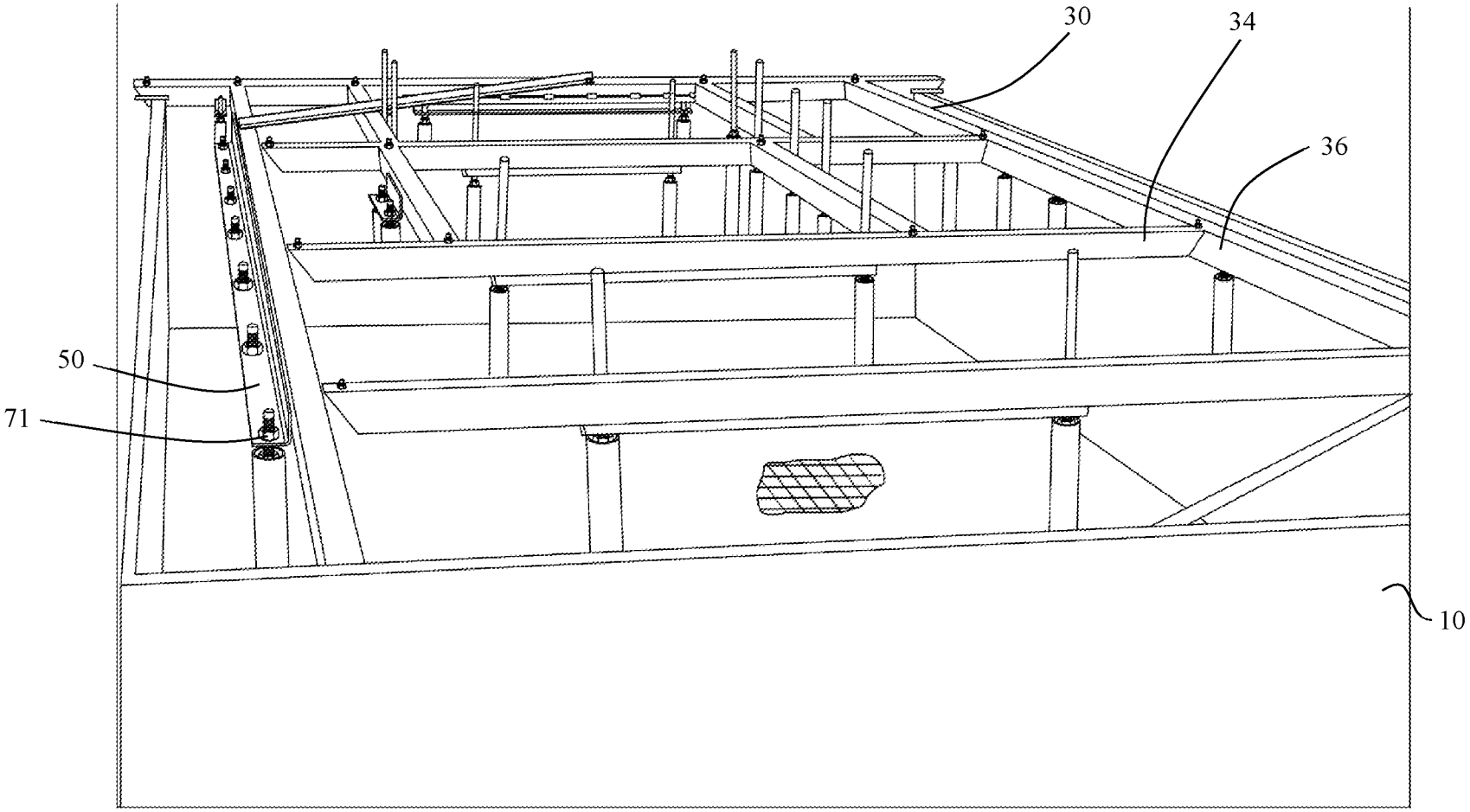
FIG. 4 is a view of the template assembly aligned with the form, showing a portion of reinforcing bar in the form.
Figure 5:
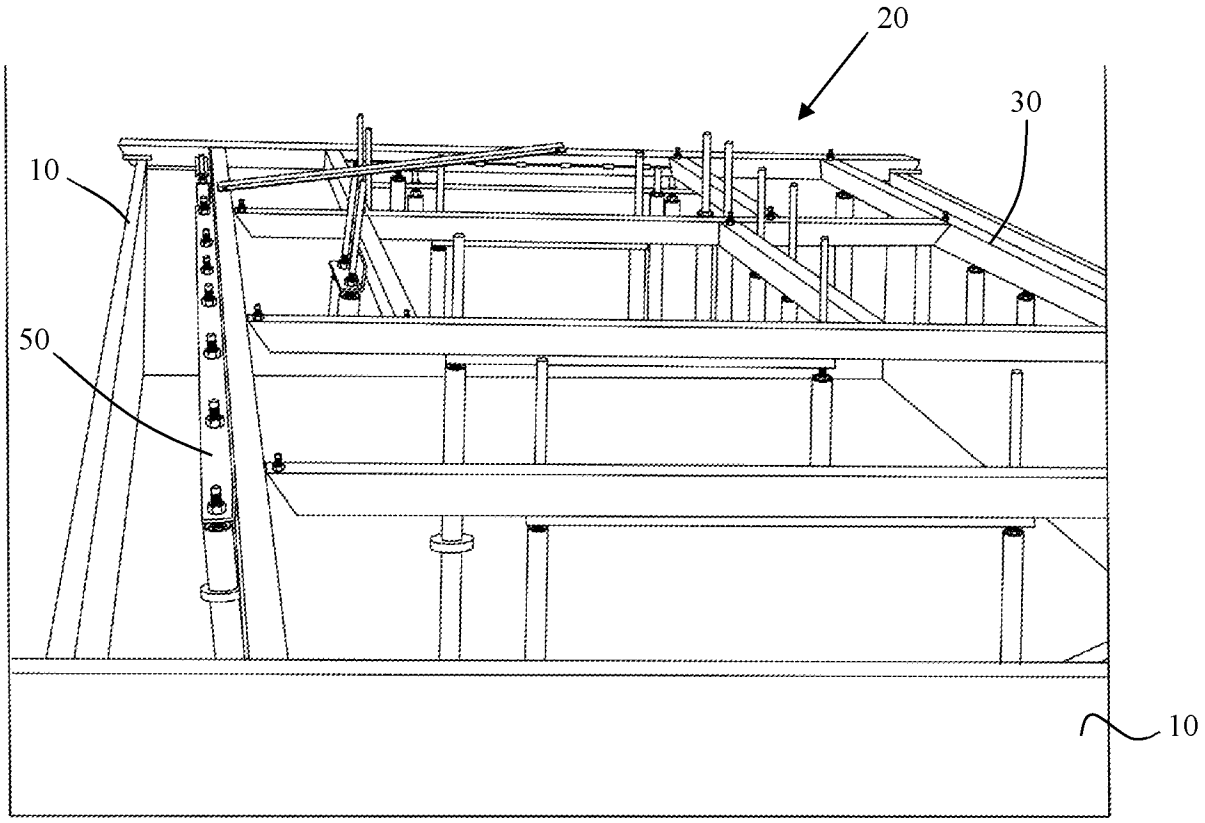
FIG. 5 is an alternative view of the template assembly aligned with the form.
Figure 6:
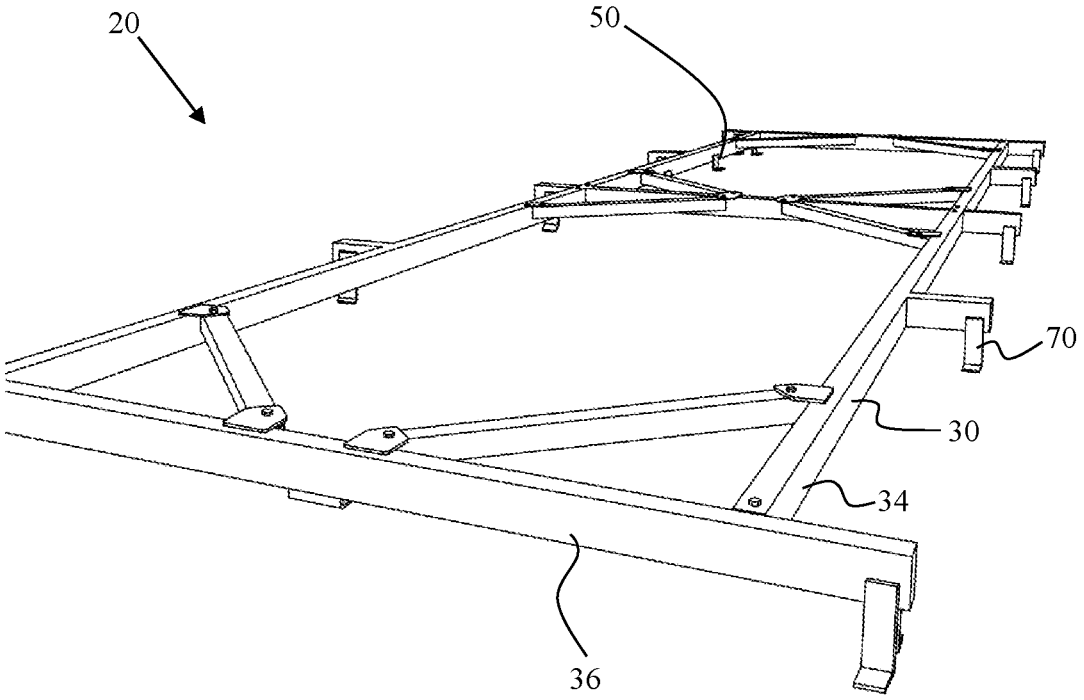
FIG. 6 is a view of the frame prior to engagement with the legs.
Figure 7:
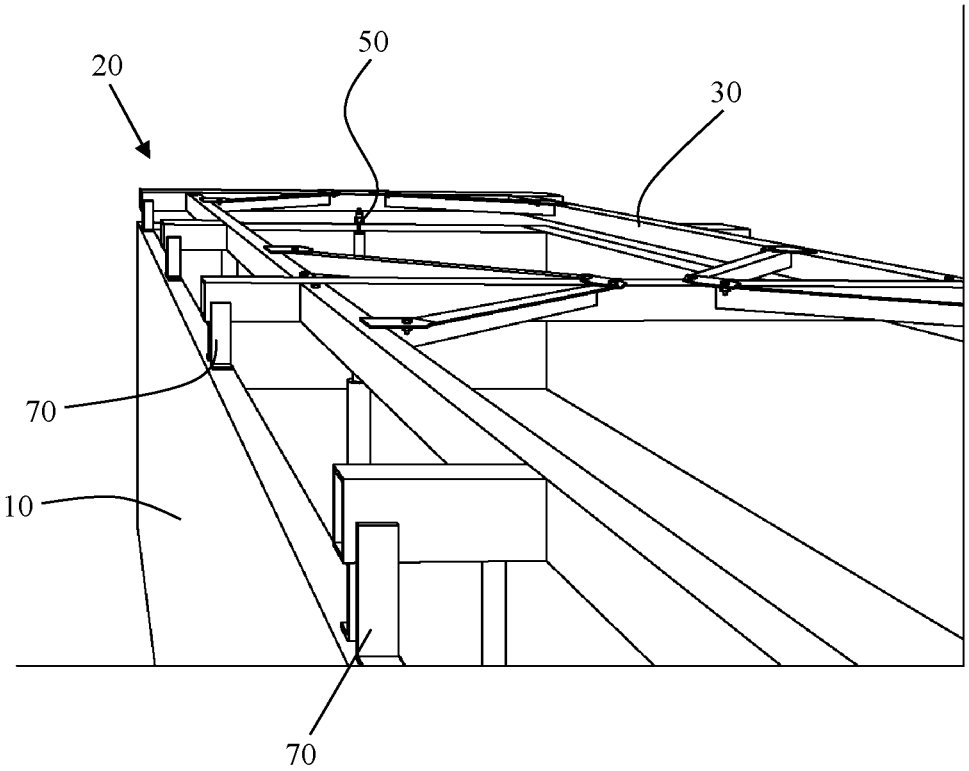
FIG. 7 is a view of the template assembly view of the template assembly aligned with the form.
Figure 8:
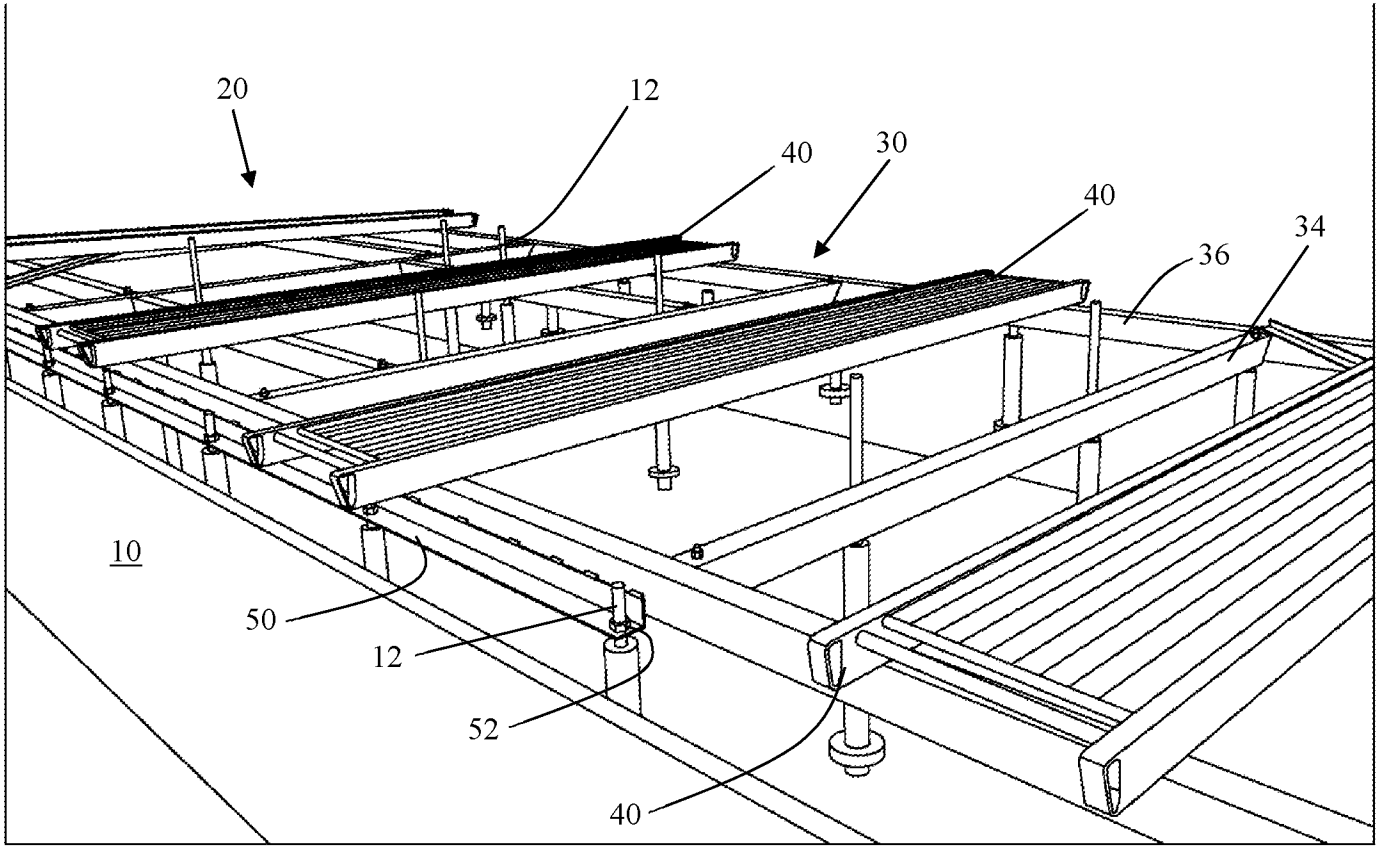
FIG. 8 is a view of the template assembly aligned with the form and temporary decking on the frame.
Figure 9:
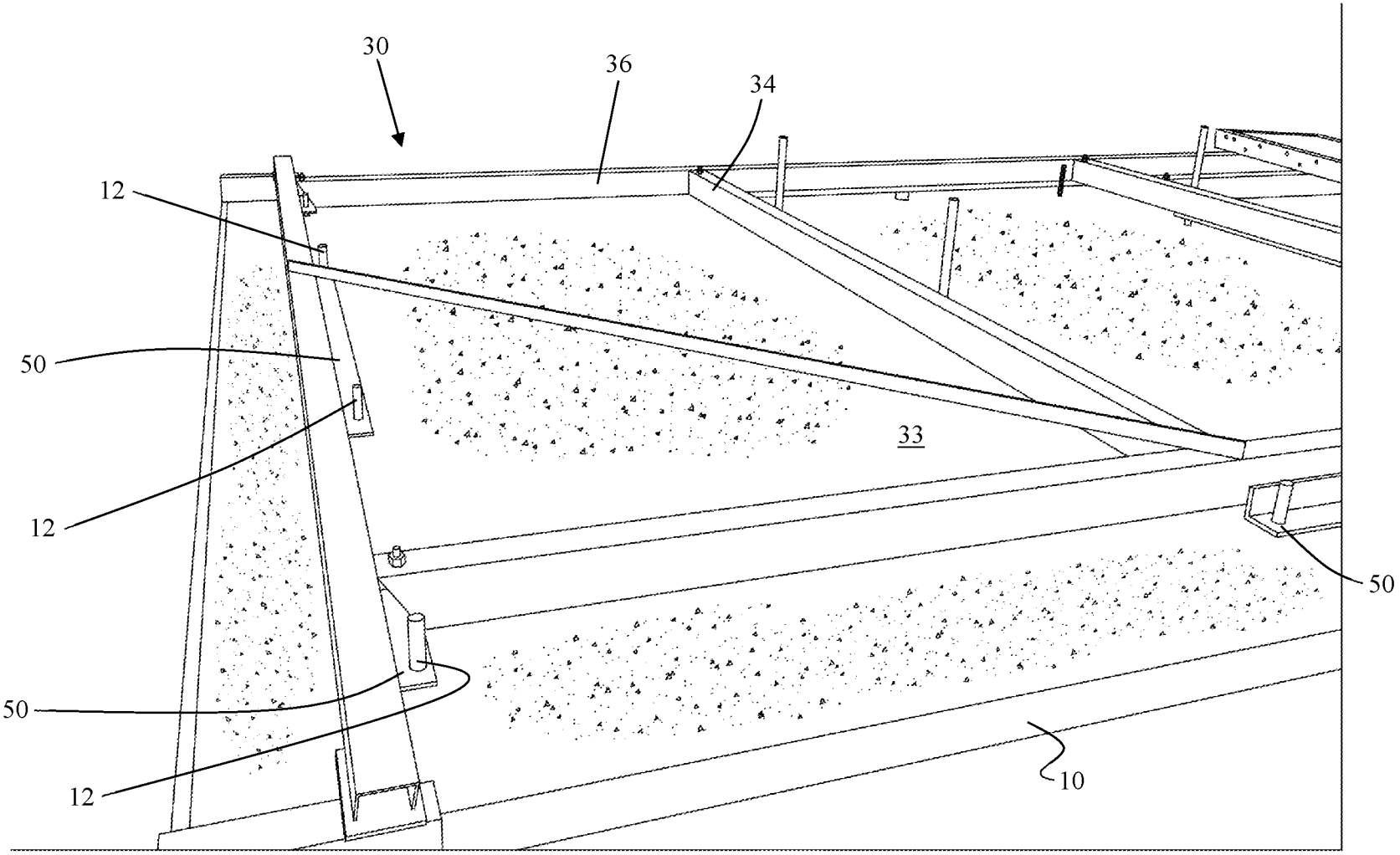
FIG. 9 is a view of the template assembly aligned with the form and access to a surface of the concrete pour for finishing.
Figure 10:
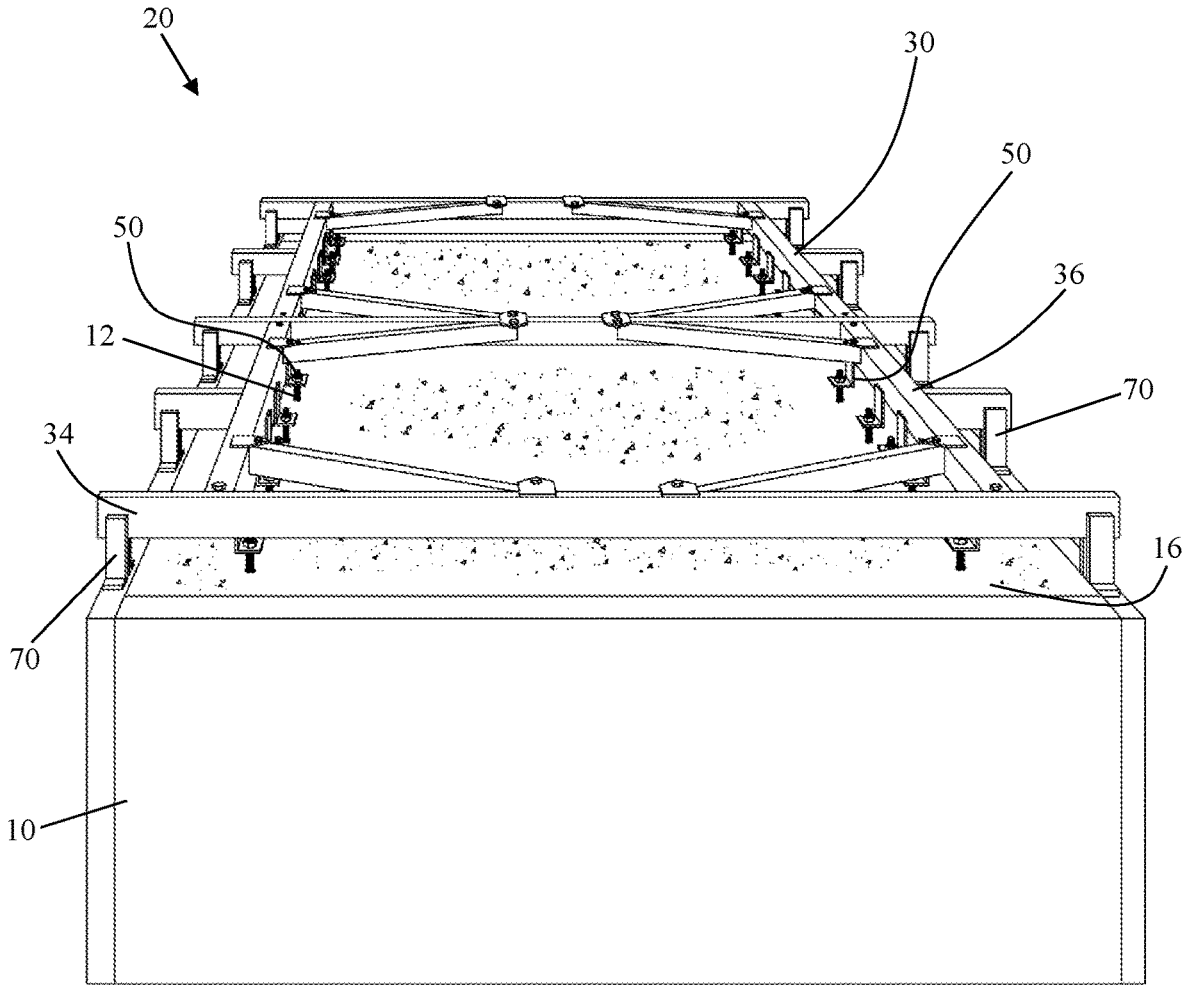
FIG. 10 is a view of the template assembly aligned with the form and access to a surface of the concrete pour and confirming predetermined locations of the anchor bolt retainers, anchor bolt engaging surfaces and/or anchor bolts.

The form 10 can have any of a variety of configurations and be built from any of a variety of materials. Typical forms 10 are constructed of wood planks or plywood sheets affixed to posts to define the form. In one configuration, the form has a cross sectional area dimension of approximately 20' by 40'. A depth (thickness) of the form 10 is at least partly dictated by the device to be attached and can range from a few inches to multiple feet. However, it is understood the form 10 is scalable and can have any of a variety of sizes, encompassing corresponding areas ranging from 10 $ft^2$ to 1,000 $ft^2$ or more and depths from an inch to 8 feet or more. As shown in a portion of FIG. 4, and omitted from other Figures for clarity, the form 10 can include the reinforcing structures or bars, rebar, as dictated by design considerations. The rebar can extend throughout the form in any of a variety of patterns. The anchor bolts 12 can also be connected to local portions of the rebar or can be independent of the rebar.

The pattern of the anchor bolts to be disposed in the form 10 can be determined by the pattern of the device to be coupled to the foundation. As set forth above, in devices, such as compressors or turbines, the pattern for the anchor bolts 12 is generally dictated by the design of the device and often has relatively small tolerances, such as 0.1 inch and in some configurations 0.01 inch and in further configurations 0.001 inch and in select configurations 0.0001 inch.

The number of anchor bolts 12 within the bolt pattern and hence the form 10, and thus the foundation, can range from approximately 5 to 500 or more. The amount or length of the anchor bolt 12 to be embedded in the foundation is also dictated by the applicable design considerations.

The template assembly 20 includes the frame 30 and a plurality of connected anchor bolt retainers 50.

In certain configurations, the template assembly 20 further includes a plurality of depending legs 70 for locating the frame at a particular elevation and particularly for locating the frame relative to the form. In one configuration, the legs 70 are independent of the form 10 and are configured to provide elevational adjustment so that the frame 30, and hence anchor bolt retainers 50 can be positioned at a preselected vertical spacing from the top of the pour in the form 10. The legs 70 are vertically adjustable such as by telescoping portions, threaded translation as well as attachable extensions. As the ground adjacent to the form 10 is often uneven, the vertical adjustment of the legs 70 provides for the frame 30 to be located at the necessary spacing from the top of the pour in the form 10.

The legs 70 can be located along the footprint of the frame 30 or can be offset outside the periphery of the frame, such that the frame is cantilevered from the legs.

It is also contemplated, the frame can be directly connected to the form. This configuration is more typical when the form is constructed of sufficiently rigid materials to directly support the frame. Thus, the frame is connected to the form, wherein the frame then locates the anchor bolt retainers relative to the form and hence foundation. Alternatively, it is contemplated the legs can be sacrificial and separated from the frame 30 after the concrete has been poured in the form. Thus, even the legs could be located within the form 10, along with any employed reinforcing bars.

In one configuration, the frame 30 is formed of metal, and depending on the size of the frame may be formed of steel angles, steel squares, steel bars, steel beams (having profiles such as, but not limited to C, H or I profiles), steel channels as well as steel tube or piping (round, rectangular or square). The specific configuration of the metal frame 30 is selected to provide a deflection or deformation over the dimensions of the frame (and hence bolt pattern) that is less than the design tolerances of the bolt pattern. In one configuration, steel tube is used to form the frame 30.

Depending on the necessary accuracy of the location of the anchor bolts 12 in the form 10, and the foundation 16, configurations of the template assembly 20 include anchor bolt retainers 50 that are fixedly connected to the frame such as by welding. The anchor bolt retainer 50 is fixedly connected to the frame 30 to retain the anchor bolt 12 within the form 10 during the pour of the concrete into the form. The anchor bolt retainer 50 includes an anchor bolt engaging surface 52 for engaging the anchor bolt 12 and effectively coupling the anchor bolt to the anchor bolt retainer. The anchor bolt engaging surface 52 can be a variety of configurations. For example, the anchor bolt engaging surface 52 can be generally tab structure with an aperture sized to receive the anchor bolt 12 or a recess sized to receive a portion of a periphery of the anchor bolt. If the anchor bolt 12 is threaded, then threaded fasteners can be engaged with the anchor bolt to capture a portion of the tab between the threaded fasteners and secure the anchor bolt to the anchor bolt retainer 50.

Alternatively, the anchor bolt retainer 50 can include a clamp or vise mechanism to engage the anchor bolt 12, and particularly the anchor bolt engaging surface 52 with the anchor bolt. It is further contemplated the anchor bolt retainer 50 can have a threaded anchor bolt engaging surface 52 for threadingly engaging a corresponding portion of the anchor bolt 12.

Although shown as each anchor bolt retainer 50 being engaged with a single anchor bolt 12, it is understood that a given anchor bolt retainer can engage a plurality of anchor bolts depending on the specific bolt pattern. Thus, the anchor bolt retainer 50 can be a generally tab shape or have a T shape to engage two anchor bolts 12. The anchor bolt retainer 50 can include a plurality of fingers, wherein each finger includes an anchor bolt engaging surface 52.

The anchor bolt retainer 50 has sufficient rigidity to preclude movement of the anchor bolt engaging surface 52 outside of the design tolerance of the bolt pattern during the pour of the concrete into the form.

The anchor bolt retainers 50 are fixedly connected to the frame 30, such as by welding. In one configuration, the connection of the anchor bolt retainers 50 to the frame 30 is sufficient to preclude non-destructive separation. In addition, the connection of the anchor bolt retainers 50 and the frame 30 does not permit movement of the anchor bolt retainer and particularly the anchor bolt engaging surface 52 relative to the frame, and hence relative to any other anchor bolt retainer and the associated anchor bolt engaging surface. Thus, the anchor bolt retainer 50 has the same dimensional stability as the frame 30 as set forth below, or better.

The frame 30 can have a variety of shapes, as typically dictated by the form 10 and the bolt pattern. In one configuration, the frame 30 is generally rectangular having parallel sides and parallel ends. Cross struts and corner angles can be included to provide the necessary rigidity.

The frame 30 can define an open area 33 or access to the concrete in the form, thereby allowing finishing of the concrete independent of the frame. Thus, for the area encompassed by the frame 30, the frame is less than 50% and in certain configurations less than 25% and in further configurations less than 15% of the area encompassed by the frame.

Alternatively, the frame 30 can overlie less than 50% and in certain configurations less than 25% and in further configurations less than 15% of the cross sectional area of the form 10.

The frame 30 and the anchor bolt retainers 50 can be configured to minimize the area overlaying the surface of the form 10 (and hence the concrete pour). Depending on the shape of the form 10 and the bolt pattern, the frame 30 can lie substantially outside the periphery of the form, wherein the anchor bolt retainers 50 extend inwardly from the frame to overlie the area of the pour. Alternatively, the frame 30 can be sized to be located within the periphery of the form 10. It is further contemplated that one portion of the frame 30 can be disposed within the periphery of the form 10 and a second portion of the frame can be located outside the periphery of the form.

Further, the frame 30 can be vertically spaced from the form 10 by a sufficient distance to allow access to the surface of the poured concrete to allow finishing of the concrete. Thus, the frame 30 can be 6 inches to 12 inches or more above the surface of the concrete in the form 10.

The rigidity of the frame 30 is selected to preclude deflection or deformation outside of the predetermined tolerances and predetermined locations, either absolute or relative. In one configuration, the rigidity of the frame 30 is selected to preclude deflection or deformation outside of the tolerances of the bolt pattern. The frame 30 can be constructed to provide tolerances of less than 0.1 inches/foot to less than 0.01 inches/foot to less than 0.001 inches/foot and less than 0.0001 inches/foot. Further, the frame 30 is selected to allow the formation of a deck 40, such as temporary wooden planking on top of the frame, such that users can reach the top of the concrete in the form 10 from the deck. This allows the concrete in the form 10, beneath the frame 30, to be finished at the appropriate time, without jeopardizing the setting of the anchor bolts 12.

The frame 30 can be manufactured at a location remote from the form 10, such as at a manufacturing location. The bolt pattern can be obtained from a manufacturer of the device to be mounted and in one configuration the bolt pattern and tolerances are provided in a computer design file. The bolt pattern defines the location of each anchor bolt 12 with respect to a fiducial or another anchor bolt. In addition, the provided bolt pattern typically includes tolerances as to the permissible deviation for the location of a given anchor bolt 12 as well as deviation relative to other anchor bolts.

For those constructions in which the assembled frame 30 is larger than overland trucking regulations, or even for convenience, the frame can be constructed of a plurality of interconnected sections or components 34, 36. The separate sections 34, 36 are connectable in a repeatable and accurate manner, typically within the tolerances of the bolt pattern. That is, the sections 34, 36 are configurable between an assembled configuration for retaining and locating the anchor bolts 12 and a transport configuration in which the sections are separated for consolidation of size. For example, the length of the sections may be limited to 53 feet or less, 48 feet or less or 45 feet or less, depending on the available trucking routes. The transverse dimension (or width) of the sections can be 102 inches or less.

In one construction, the data file from the manufacturer of the device is used to set the location of the anchor bolt retainers 50 (and anchor bolt engaging surfaces 52) relative to each other and the frame 30. The anchor bolt retainers 50 are then affixed to the frame 30, such as by welding. While the anchor bolts 12 can be attached to the frame 30 by other mechanisms such as threaded fasteners, such mechanisms can allow "play" or deflection which is not present in the welded connections. Thus, in one configuration the anchor bolt retainers 50 are welded to the frame 30.

The location of the affixed anchor bolt retainers 50 (and anchor bolt engaging surfaces 52) is then measured, such as by a commercially available laser measurement system, including but not limited to digital laser measuring devices by Bosch such as the GLM 20, Fluke 424D and DeWalt DW03050. The measured locations of the affixed anchor bolt retainers 50 are compared to the bolt pattern data file (as typically supplied by the manufacturer of the device). Adjustments can then be made to the assembled frame 30 and anchor bolt retainers 50 to ensure compliance with the provided bolt pattern.

In one configuration, a plurality of legs 70 or sockets 71 for receiving the legs are affixed to the frame 30. The legs 70 are sized to locate the frame 30 and hence affixed anchor bolt retainers 50 at an elevation relative to the form 10 and particularly the top surface of the poured concrete. The legs 70 can be adjustable attached to the frame 30 or include a self-contained height adjustment. Typically, the elevation of the frame 30 relative to the top surface of the concrete is typically not as critical as the relative positioning of the anchor bolt retainers 50.

It is anticipated that documentation, electronic or hard-copy, can be made of the assembled and aligned template assembly 20 at the manufacturing location. That is, drawings can be prepared of the template assembly for field use. Additionally, or alternatively, electronic files of the template assembly 20 can be made and transferred to the installation site.

The sections 34, 36 of the frame 30 are then dissembled and the sections packed for shipment to the form site. The frame 30 is then reassembled at the form site. The legs 70 locate the frame 30 relative to the form 10. The legs 70 can engage the form 10 directly or can independently rest on an adjacent foundation, floor or ground. Thus, the independent location of the legs allows the frame 30 to "float" relative to the form 10, thereby decoupling movement of the form from movement of the template assembly 20. By floating the template assembly 20, the accuracy of the template assembly and hence bolt pattern is isolated from any movement of the form 10. This allows the form to be economically constructed without having to provide the required accuracy (tolerances) of the bolt pattern. Alternatively, as the template assembly 20 is constructed to provide the necessary tolerances, it is possible to locate the template assembly as a portion of the form. Thus, while the form may flex and move the location of the template assembly 20, the template assembly rigidity maintains the necessary relative location of the anchor bolt retainers 50.

In one process, in the reassembled template assembly 20, the relative location of the anchor bolt retainers 50 (or anchor bolt engaging surfaces 52) are re-measured, such as by the commercially available laser measurement systems set forth above, with the frame 30 located to engage the anchor bolts with the anchor bolt retainers 50. Each anchor bolt 12 is engaged with a corresponding anchor bolt retainer 50 (or bolts depending on the specific configuration of the anchor bolt retainer). For example, a threaded fastener can be engaged with the anchor bolt 12, then an aperture in the anchor bolt retainer 50, defining the anchor bolt engaging surface 52, receives the anchor bolt and a second threaded fastener engages the anchor bolt to capture a portion of the anchor bolt retainer 50 between the threaded fasteners. This fixes the location of the anchor bolt 12 relative to the frame 30 both in the horizontal X-Y plane as well as vertically along the Z axis. Thus, the amount or portion of the anchor bolt 12 to be embedded within the foundation can be set by the template assembly 20.

The positions of the anchor bolts 12 or corresponding surface is then re-measured and any necessary adjustments are made. The form 10 is then ready to receive the concrete pour. During and/or after the pour, the positions of the anchor bolts 12, or corresponding engaging surfaces 52, are then re-measured and any necessary adjustments are made, prior to setting of the concrete.

The pour is completed and the form 10 filled with concrete as well known in the art, including any vibration.

Because the frame 30 allows access to at least a majority of the surface of the pour as set forth above, and the frame can support the temporary deck 40, the concrete can be finished at an appropriate time during the cure.

Upon the concrete being sufficiently cured, the anchor bolt retainers 50 are disengaged from the anchor bolts 12 and the template assembly 20 is removed from the form 10.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An assembly for locating a plurality of anchor bolts in a predetermined relationship within a concrete pour, the assembly comprising:

(a) a form configured to receive the concrete pour;

(b) a metal frame comprising elongate metal side members and metal cross members interconnecting the elongate metal side members;

(c) a plurality of vertically adjustable legs projecting from the metal frame, the plurality of vertically adjustable legs being independent of the form and configured to decouple movement of the form from movement of the metal frame; and (d) a plurality of anchor bolt retainers fixedly connected to the metal frame, each anchor bolt retainer fixedly connected at a corresponding single position, each anchor bolt retainer including an anchor bolt engaging surface, wherein each anchor bolt engaging surface is disposed in a fixed predetermined position relative to a remaining subset of the plurality of anchor bolt engaging surfaces, wherein the plurality of vertically adjustable legs, the metal frame, and the form are configured for the vertically adjustable legs to adjust an elevational spacing of the plurality of anchor bolt retainers relative to the form.

2. The assembly of claim 1, wherein the metal frame comprises a plurality of components moveable between a transport configuration and a template configuration.

3. The assembly of claim 1, wherein the plurality of anchor bolt retainers are welded to the metal frame.

4. The assembly of claim 1, wherein the metal frame has sufficient rigidity to preclude deflection of more than 0.1 inches from a weight of the metal frame over a length of the metal frame.

5. The assembly of claim 1, wherein a deflection of the metal frame from a weight of the metal frame is less than 0.1 inches over a length of the metal frame.

6. The assembly of claim 1, wherein a deflection of the metal frame from a weight of the metal frame is less than 0.01 inches over a length of the metal frame.

7. The assembly of claim 1, wherein at least a portion of the metal frame is formed of tube steel.

8. The assembly of claim 1, wherein the plurality of vertically adjustable legs are configured to be located outside a periphery of the form.

9. An assembly configured to locate a plurality of anchor bolts in a predetermined relationship within a concrete pour, the assembly comprising:

(a) a form configured to receive the concrete pour, the form having a cross sectional area;

(b) a metal frame comprising elongate metal side members and metal cross members interconnecting the elongate metal side members;

(c) a plurality of vertically adjustable legs projecting from the metal frame, the vertically adjustable legs configured to adjust an elevation of the metal frame relative to the form; and (d) a plurality of anchor bolt retainers fixedly connected to the metal frame, each anchor bolt retainer including an anchor bolt engaging surface, wherein each anchor bolt engaging surface is disposed in a fixed predetermined position relative to a remaining subset of the plurality of anchor bolt engaging surfaces, and wherein the plurality of vertically adjustable legs and the metal frame are configured for the vertically adjustable legs to adjust an elevational spacing of the plurality of anchor bolt retainers independent of the form to float the plurality of anchor bolt retainers relative to the form to decouple movement of the form from movement of the metal frame;

(e) wherein the metal frame overlies less than 25% of the cross sectional area.

10. The assembly of claim 9, wherein the metal frame overlies less than 15% of the cross sectional area.

11. An assembly configured to locate a plurality of anchor bolts in a predetermined relationship, the assembly comprising:

(a) a form configured to receive a concrete pour, the form having a cross sectional area;

(b) a metal frame defining a frame periphery;

(c) a plurality of vertically adjustable legs projecting from the metal frame, the plurality of vertically adjustable legs configured to locate the metal frame at a first elevational position and a second elevational position relative to the form, wherein the plurality of vertically adjustable legs are independent from the form; and (d) a plurality of anchor bolt retainers fixedly connected to the metal frame, each anchor bolt retainer including an anchor bolt engaging surface, wherein each anchor bolt engaging surface is disposed in a fixed predetermined position relative to a remaining subset of the plurality of anchor bolt engaging surfaces, wherein the plurality of vertically adjustable legs and the metal frame are configured for the vertically adjustable legs to adjust an elevational spacing of the plurality of anchor bolt retainers independent of the form to float the plurality of anchor bolt retainers relative to the form to decouple movement of the form from movement of the metal frame.

* * * * *